US007154389B2

(12) United States Patent
Marsden et al.

(10) Patent No.: US 7,154,389 B2
(45) Date of Patent: Dec. 26, 2006

(54) MONITOR FOR SENSING AND TRANSMITTING SOUNDS IN A BABY'S VICINITY

(75) Inventors: Andrew W. Marsden, Hingham, MA (US); Joseph C. Cacciola, Wrentham, MA (US); Anthony Wong, Franklin, MA (US)

(73) Assignee: Cosco Management, Inc., Wilmington, DE (US)

( * ) Notice: Subject to any disclaimer, the term of this patent is extended or adjusted under 35 U.S.C. 154(b) by 216 days.

(21) Appl. No.: 10/697,627

(22) Filed: Oct. 30, 2003

(65) Prior Publication Data

US 2005/0093694 A1 May 5, 2005

(51) Int. Cl.
*G08B 1/08* (2006.01)

(52) U.S. Cl. ..... 340/539.15; 340/539.11; 340/539.14; 340/693.5; 340/693.9

(58) Field of Classification Search ..... 340/573.1, 340/539.1, 539.11, 539.14, 539.15, 693.5, 340/693.9

See application file for complete search history.

(56) References Cited

U.S. PATENT DOCUMENTS

| | | | | |
|---|---|---|---|---|
| 4,106,001 | A | | 8/1978 | Mahoney |
| 5,196,828 | A | | 3/1993 | Keniston |
| 5,210,532 | A | | 5/1993 | Knoedler et al. |
| 5,280,635 | A | * | 1/1994 | Knoedler et al. ..... 455/128 |
| 5,438,315 | A | | 8/1995 | Nix |
| 5,463,371 | A | | 10/1995 | Fuller |
| 5,512,880 | A | | 4/1996 | Abrams et al. |
| 5,757,274 | A | | 5/1998 | Slomowitz et al. |
| 5,768,696 | A | | 6/1998 | Law |
| 5,914,660 | A | | 6/1999 | Mesibov et al. |
| 6,043,747 | A | | 3/2000 | Altenhofen |
| 6,054,926 | A | | 4/2000 | Deleo |
| 6,084,527 | A | | 7/2000 | Spector |
| 6,462,664 | B1 | | 10/2002 | Cuijpers et al. |
| 6,476,724 | B1 | | 11/2002 | Slomowitz et al. |
| 6,522,259 | B1 | | 2/2003 | Tamura |
| 2002/0057202 | A1 | | 5/2002 | Luzon |
| 2002/0101350 | A1 | | 8/2002 | Thompson |
| 2002/0169583 | A1 | | 11/2002 | Gutta et al. |
| 2005/0184877 | A1 | * | 8/2005 | Thompson ..... 340/573.1 |

* cited by examiner

*Primary Examiner*—Julie Bichngoc Lieu
(74) *Attorney, Agent, or Firm*—Barnes & Thornburg LLP

(57) ABSTRACT

The present disclosure relates to a monitor for sensing and transmitting sounds in a baby's vicinity. The monitor includes a housing having a base and two substantially spaced-apart legs, the housing enclosing acoustical and electrical means for sensing and transmitting the sounds. The monitor is mountable on a support by straddling the support with the substantially spaced-apart legs. The present disclosure also relates to a sound monitoring system. The system includes the monitor, a receiver, and a charger. Further, the present disclosure relates to a method of securedly and releasably mounting the monitor to a support.

37 Claims, 5 Drawing Sheets

MONITOR FOR SENSING AND TRANSMITTING SOUNDS IN A BABY'S VICINITY

BACKGROUND

The present disclosure relates to sound monitors, particularly monitors that sense and transmit sounds in a vicinity or environment of a baby. The monitors are mountable on a support, such as, for example, on a baby's crib or playpen.

Such monitors and related monitoring or sensing systems are known in the art. They include sensors that detect a baby's sounds, movements and/or the position of a crib's gate. Also included are transmitters that transmit those sounds to receivers or play sounds out loud in the vicinity of the baby. Those monitoring or sensing systems generally include baby sensing/transmitting units and parent/caregiver receiver units. The parent/caregiver receiver units are generally remotely located from the baby sensing/transmitting unit. The baby and parent units are generally battery powered. The batteries may be rechargeable using charging units or may be replaceable. The baby and parent units may have visual and oral displays and/or alarms. The baby sensing/transmitting units generally have attaching or fastening means, such as hooks to mount, for example, on the baby's crib or playpen.

SUMMARY

According to the present disclosure, a monitor for sensing and transmitting sounds, particularly the sounds in and around, for example, a baby's crib or playpen, includes a housing having a base and two substantially spaced-apart legs. The housing encloses acoustical and electrical means for, respectively, sensing and transmitting the sounds. The monitor is mountable on a support by straddling the support with the two substantially spaced-apart legs.

In an embodiment of the present disclosure, the housing may be U-shaped with the substantially spaced-apart legs being essentially of equal length and essentially parallel to one another.

In another embodiment, the monitor may include a securing mechanism which may include a detent resiliently mounted on the housing.

The present disclosure further relates to a sound monitoring system including a monitor for sensing and transmitting sounds in a baby's vicinity, a remotely located receiver and a charger configured to mountably receive and re-energize the monitor.

The present disclosure also includes a method of securedly and releasably mounting a monitor to a support, the monitor sensing and transmitting sounds in a baby's vicinity, and the monitor having a securing mechanism.

Other aspects of the present disclosure will become apparent from the following descriptions when considered in conjunction with the accompanying drawings.

DETAILED DESCRIPTION OF THE DRAWINGS

Figure 1:
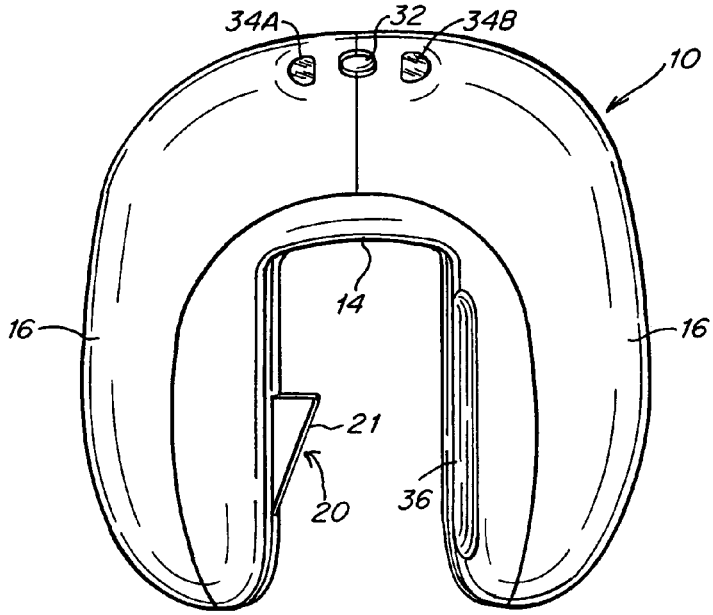
FIG. 1 is a perspective view of a monitor, according to the present disclosure.

An embodiment of the present disclosure includes a monitor 10 for monitoring sounds in the vicinity of a baby, as shown, for example, in FIGS. 1–4 and 6. Monitor 10 includes a housing 12 having a base 14 and two substantially spaced-apart legs 16. The housing 12 encloses acoustical means (partially shown, as noted below) and electrical means (not shown) for sensing and transmitting the sounds. Each of these means are well-known and commercially available, and need not be shown. The monitor 10 is mountable on a support 18, for example, a railing of a baby's crib 13 (see FIG. 7), by straddling the support 18, or rail of the crib 13, with the substantially spaced-apart legs 16. The base 14 may rest upon the support 18, as shown, for example, in FIG. 7.

The housing 12 may be U-shaped, with the legs 16 being essentially of equal length and essentially parallel to each other, as shown in FIGS. 1–4 and 6. Or, the housing 12 may be of another shape, such as a V-shape (not shown). Or, the legs 16 may have a small taper (not shown) to accommodate different dimensions of support 18.

Figure 2:
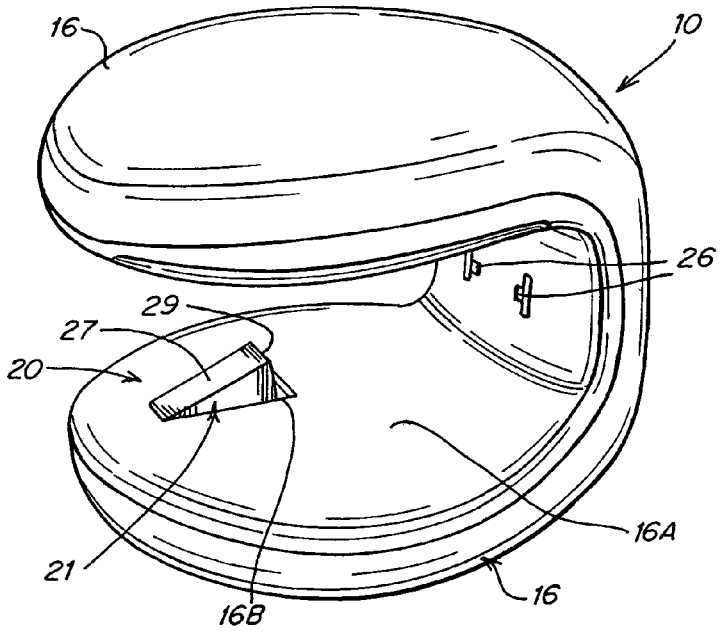
FIG. 2 is another perspective view of the monitor of FIG. 1.
Figure 2A:
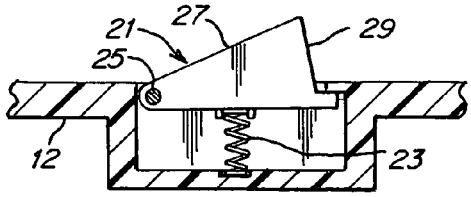
FIG. 2A is a partial cross-sectional view of a resiliently-mounted detent of the monitor of FIG. 2.
Figure 3:
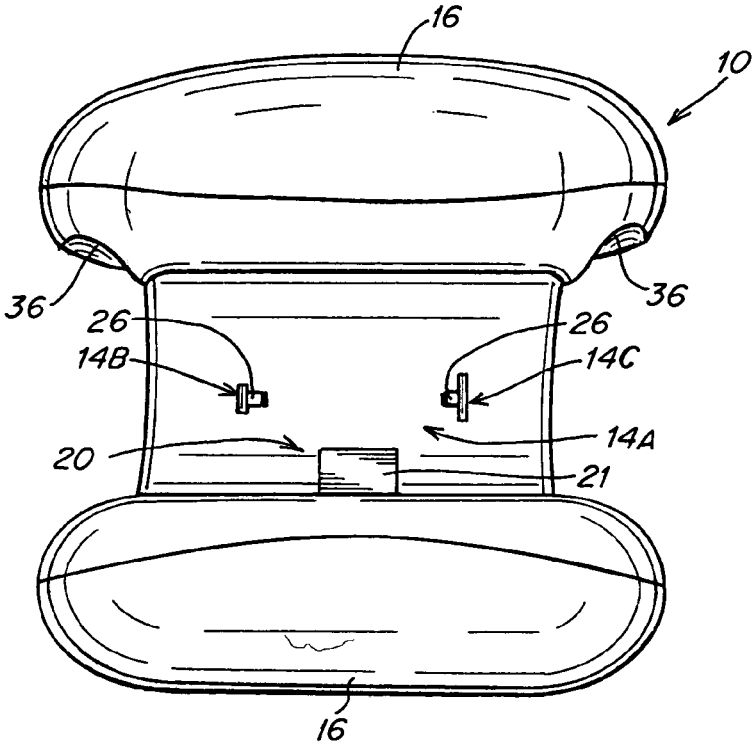
FIG. 3 is a bottom view of the monitor of FIG. 1.
Figure 4:
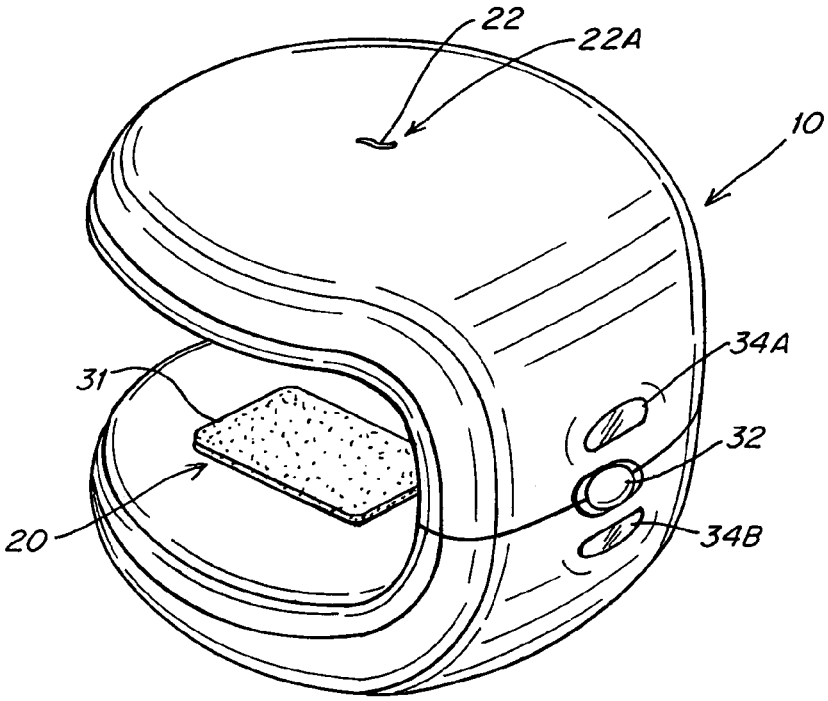
FIG. 4 is another perspective view of the monitor of FIG. 1.

The monitor 10 may also include a securing mechanism 20. The securing mechanism 20 may be a detent 21, as shown in FIGS. 1–3. The detent 21 may be pivotally, resiliently mounted in an opening 16B in the housing 12, as shown in FIG. 2A. The resilient mounting may be by, for instance, a spring 23, as shown in FIG. 2A, or it may be an equivalent resilient element (not shown). The spring 23 may be pivotally-mounted by a pin 25, as shown in FIG. 2A. The detent 21 may be mounted on an interior surface 16A of one of the spaced-apart legs 16, as shown in FIGS. 1–3. The detent 21 is configured to recess into the housing 12 when cam surface 27 contacts the support 18, and retracts back to releasably secure the housing 12 on the support 18 via locking surface 29 of detent 21. For additional security, a detent 21 may be mounted on both legs 16 (not shown) or on another location or locations on the housing 12 (not shown). The two substantially spaced-apart legs 16 are configured such that if the detent 21 is, for example, on one of the substantially spaced-apart legs 16, the other spaced-apart leg 16 is of sufficient length to substantially overlap, mask or cover the detent 21. If the detent 21 is, for example, on both legs 16, then both legs 16 are of sufficient length to overlap the detent 21 on the opposite leg 16. It is also conceivable that the securing mechanism 20 may include resilient material 31, such as rubber or rubber-like material, mounted on at least one leg 16 (as shown in FIG. 4), thereby permitting a releasable securing of the monitor 10 on the support 18, with or without a detent 21. The resilient material 31 may be mounted on both legs 16 (not shown). The resilient material 31 may also include a relatively high level of friction on its surface to prevent a removal of the monitor 10 by a baby. The securing mechanism 20 may also be a ball-type detent (not shown) resiliently mounted on the housing 12.

For a dismounting of the monitor 10 from the support 18, the detent 21 is depressed such that it recesses into the housing 12 sufficiently for the housing 12 to be lifted clear of the support 18.

Figure 5:
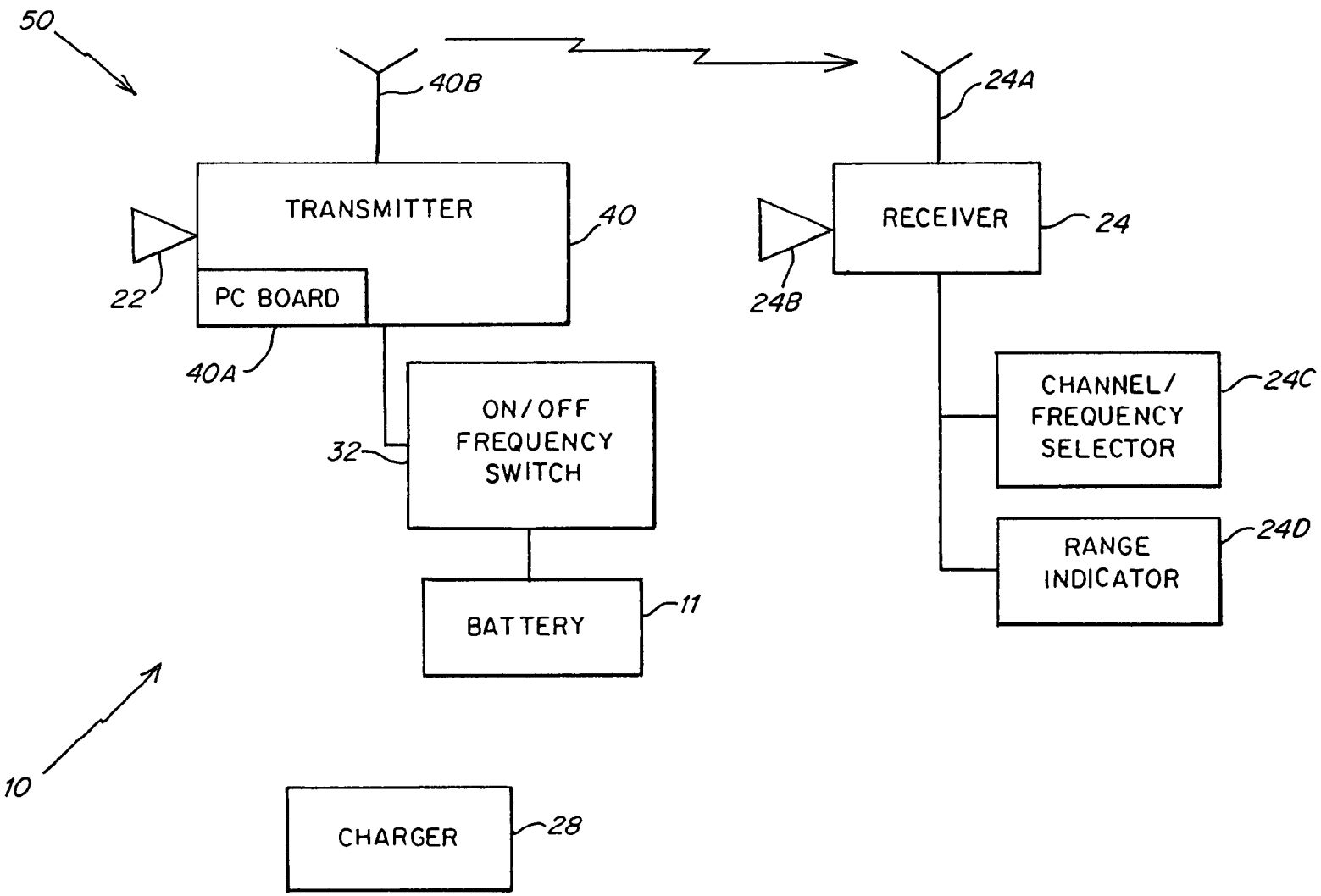
FIG. 5 is a schematic of a sound monitoring system, according to the present disclosure.

The acoustical means may include a microphone 22 mounted in one leg 16 of the housing 12. The housing 12 may have openings 22A, as shown in FIG. 4, permitting the microphone 22 to sense or detect the sounds, for example, from a baby or from another person or activity in the baby's room or area. As shown in the schematic of FIG. 5, the electrical means may include a device or devices, for example, a transmitter 40 having a PC board 40A, mounted, for instance, inside the base 14, which electrical means can convert the acoustically-detected sounds to radio waves to transmit via antenna 40B to a remotely-located receiver 24 having an antenna 24A.

The monitor 10 may also include at least one battery 11 (see schematic of FIG. 5), which may be located in a leg 16 of the housing 12, the housing 12 having a removably attachable cover (not shown). The at least one battery may be rechargeable and replaceable or not rechargeable but still replaceable. Accordingly, the monitor 10 may further include charging contacts 26 on a surface 14A of base 14 (see FIG. 3), the contacts 26 being adapted to re-energize the rechargeable batteries when contacts 26 are mated with contacts 30 on a charger 28 (see FIG. 6). The charging contacts 26 are mounted in openings 14B, 14C in housing 12. Each opening 14B, 14C may have a different dimension and/or configuration. The charging contacts 30 are mounted in openings 28A, 28B on a surface 28C of charger 28 (see FIG. 6). Each opening 28A, 28B may be at least partially surrounded by a pair of bosses 28D, 28E. For polarity reasons, the shape and dimensions (i.e., width and height) of the bosses 28D, 28E are such that they can only mate with the similarly configured openings 14B, 14C on base 14 of monitor 10. That is, to recharge the batteries, when mating the monitor 10 on the charger 28, the bosses 28D, 28E must be aligned with the appropriately configured openings 14B, 14C, whereby the bosses 28D, 28E fit into and snap somewhat securely with openings 14B, 14C. The charger 28 may also include an indicator light 28F (see FIG. 6) that illuminates when the charger 28 is connected to its power source (not shown).

Figure 6:
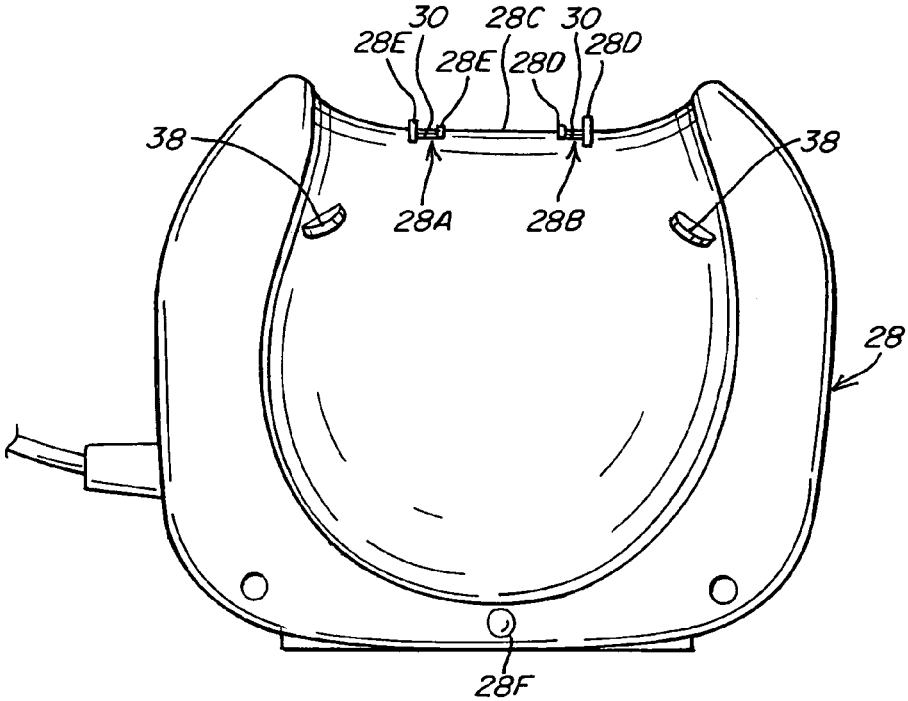
FIG. 6 is a side view of a charger, according to the present disclosure.

For mating and polarity reasons, the housing 12 may also include at least one guide 36, shown as an indentation in FIG. 3, adapted to align with at least one protrusion 38 on the charger 28. That alignment permits a correct matching of contacts 26 and 30 when mounting the monitor 10 on the charger 28, and thereby making possible, for polarity purposes, a recharging of the at least one battery 11 of the monitor 10. As shown in FIG. 3, the at least one guide 36 includes two guides 36, on a same side of monitor 10, one on each leg 16. As shown in FIG. 6, the at least one protrusion 38 includes two protrusions 38, both on a same side of the charger 28. It is conceivable that the protrusions 38 could be on the legs 16 of the monitor 10 and the guides 36 could be on the charger 28. Other configurations and/or equivalents of guides 36 and protrusions 38 are conceivable. It should be noted that, for alignment of the monitor 10 and charger 28, both alignment devices are not necessary. That is, an employment of the sets of bosses 28D, 28E matching with openings 14B, 14C may be sufficient, or employment of the guides 36 and protrusions 38 may be sufficient.

The housing 12 may further include a switch 32 to turn on the monitor 10 and the switch 32 may permit a selection of one or more transmitting frequencies for the monitor 10. The switch 32 may be a three-position switch with one position being off and the other two positions each being on and also being a frequency selection. If no frequency selection or choice is desired, switch 32 would be a simple two-position on/off switch. The housing 12 may further include indicator lights 34A, 34B showing a status of the power condition of the monitor 10. For example, one of the lights, 34A, may illuminate green to indicate that the at least one battery 11 in the monitor 10 is charged, and the other light 34B may illuminate red to indicate that the power in the at least one battery 11 is low. While two indicator lights 34A, 34B are shown in FIG. 4, it is conceivable that one light (not shown) could be used instead.

Figure 5A:
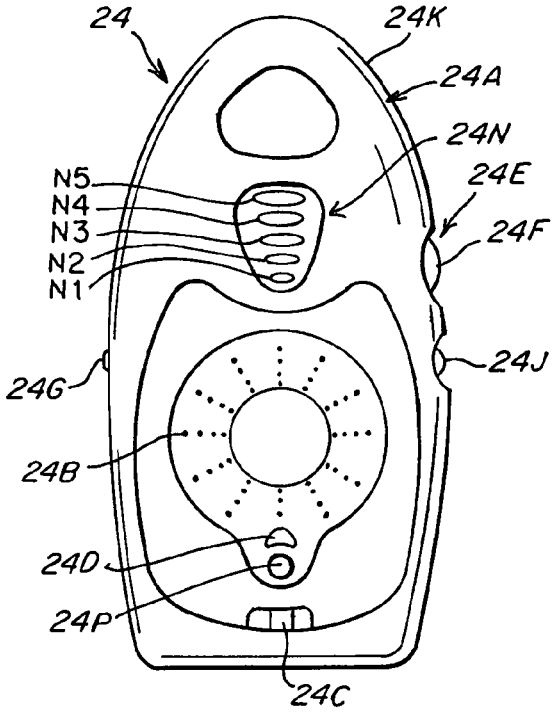
FIG. 5A is a front view of a receiver, according to the present disclosure.
Figure 5B:
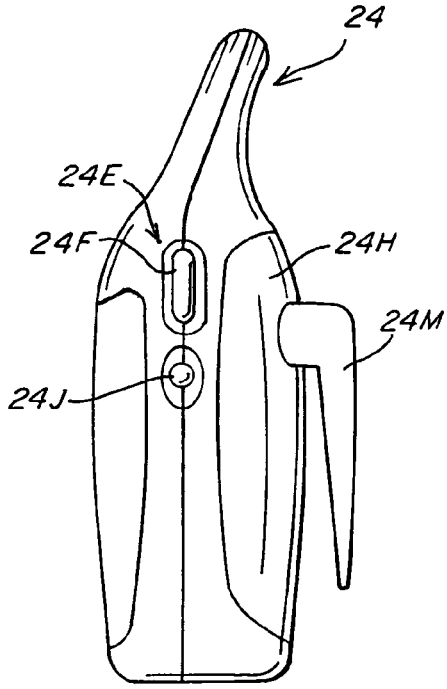
FIG. 5B is a side view of the receiver of FIG. 5A.

The present disclosure also includes a sound monitoring system 50 (shown schematically in FIG. 5) for sensing, transmitting and receiving sounds in a baby's vicinity. The monitoring system 50 includes the monitor 10 of FIGS. 1–4. Also included is a receiver 24 (shown in FIGS. 5A and 5B), which may be remotely located from the monitor 10. The receiver 24 receives the transmitted sounds from the monitor 10 via antenna 24A and announces the sounds out loud, via a speaker or announcer 24B. The receiver 24 includes a channel selector 24C (see FIGS. 5–5A) to select one of at least two frequencies that corresponds to a frequency transmitting the sounds from the monitor 10. Also included is range indicator 24D showing whether the receiver 24 in within a receiving range of the sounds transmitted by the monitor 10. The receiver 24 also includes an on/off/volume switch 24E having a dial 24F. A pressing of the dial 24F of switch 24E turns the receiver 24 on and off. Rotation of the dial 24F adjusts the volume. The receiver 24 may also have a power jack 24G adapted to receive power from a DC source (not shown). Also included may be a compartment 24H on the receiver 24 for enclosing replaceable batteries (not shown). Further included may be a vibrate switch 24J that, when activated, permits the receiver 24 to vibrate when receiving a transmission from the monitor 10. The receiver 24 may also include a handle 24K, which may house antenna 24A. The receiver 24 may also include another handle 24M which allows the receiver 24 to be carried, for, example, on a belt (not shown). The receiver 24 may also include a noise level indicator 24N. The noise level indicator 24N indicates the level of noise or sound volume in and around the vicinity of the baby. For example, the indicator 24 is illustrated as five bar panels N1, N2, N3, N4, N5 which are sequentially and accumulatively lit such that the number of panels lit illustrate the volume of sound in the vicinity of the baby. The receiver 24 may also have a power indicator 24P, which may be a light that illuminates one color indicating that the batteries are charged and another color indicating low battery power. Further included in the sound monitoring system 50 is the charger 28 of FIG. 6.

FIG. 5 is a schematic representation of the sound monitoring system 50, including monitor 10, charger 28 and receiver 24. Microphone 22 detects sounds in the baby's vicinity, and PC board 40A converts the sounds to radio waves, which are sent by transmitter 40 via antenna 40B. The radio waves are received via antenna 24A of receiver 24. A user can turn the monitor 10 on and off with switch 32, and, if so configured, select a transmitting frequency as well. Battery 11 may be rechargeable by mating monitor 10 with changer 28.

Figure 7:
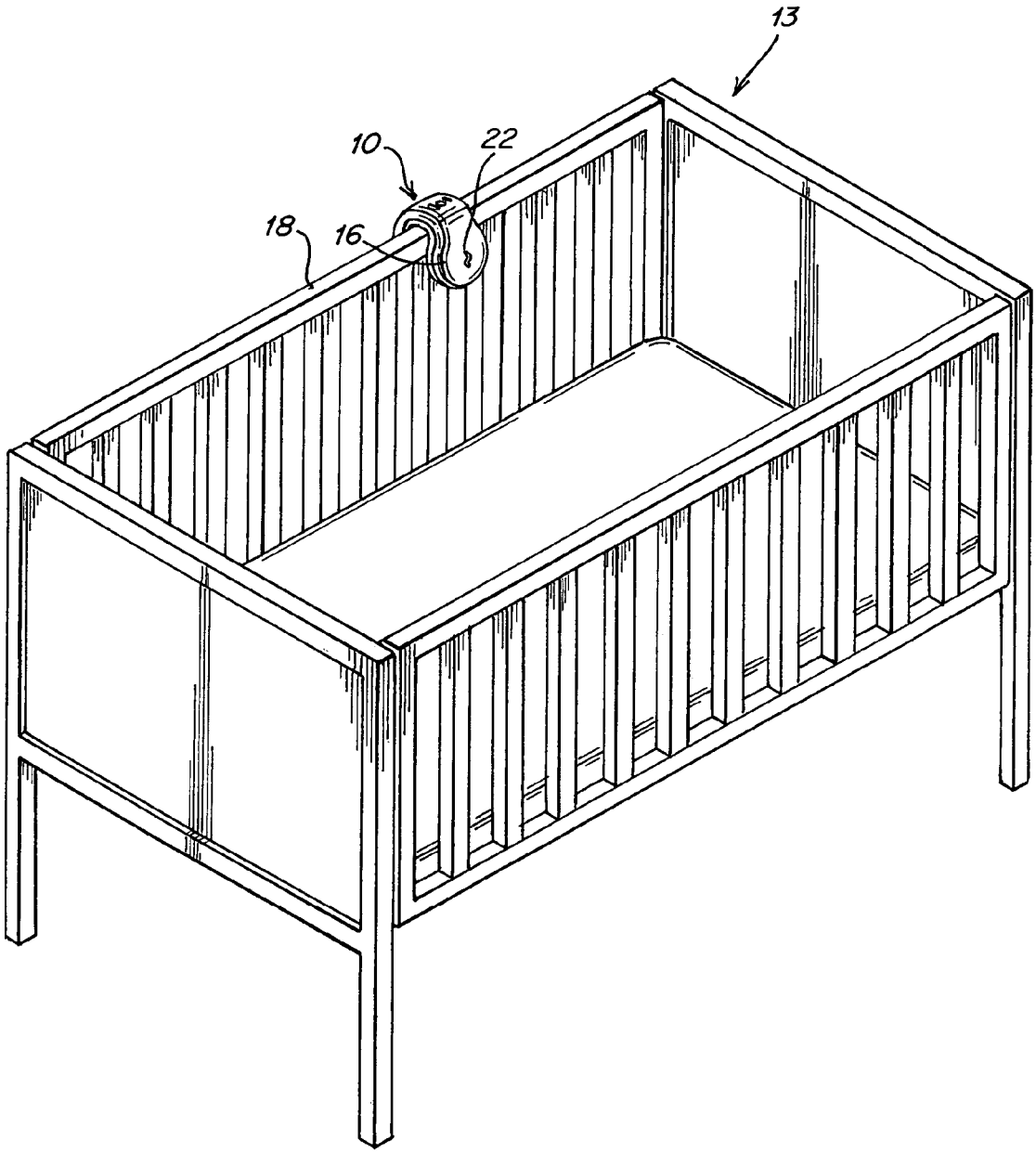
FIG. 7 is a perspective view of a baby's crib, with the monitor of FIG. 1 mounted on a support, or rail of the crib.

The present disclosure also includes a method of securedly and releasably mounting the monitor 10 to the support 18. A mounted monitor 10 is shown in FIG. 7. The method includes the following steps: providing a monitor 10 that senses and transmits sounds in a baby's vicinity, the monitor 10 including a housing 12 having a base 14, two spaced-apart legs 16 and a securing mechanism 20, and the housing 12 enclosing means for sensing and means for transmitting the sounds, and the securing mechanism 20 including a resiliently mounted detent 21; straddling the support 18 with the spaced-apart legs 16; engaging the resiliently mounted detent 21 with the support 18, thereby recessing the resiliently mounted detent 21 into the housing 12; and, pushing the spaced-apart legs 16 around the support 18 until the resiliently mounted detent 21 retracts back, thereby releasably securing the monitor 10 to the support 18. The monitor 10 may be mounted, for example, over a top of a rail of a crib 13 (as shown in FIG. 7), or the monitor 10 may be mounted from a side of the rail (not shown). That is, the monitor 10 may be mounted from a variety of directions or from different sides of a support 18.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A monitor for sensing and transmitting sounds in a baby's vicinity, comprising:

a housing having a base and two integral substantially spaced-apart legs, the housing and both legs enclosing acoustical means and electrical means for, respectively, sensing and transmitting the sounds; and the monitor being mountable on a support by straddling the support with the spaced-apart legs.

2. The monitor of claim 1, wherein the housing is U-shaped with the substantially spaced-apart legs being essentially of equal length and essentially parallel to each other.

3. The monitor of claim 1, further including a securing mechanism.

4. The monitor of claim 3, wherein the securing mechanism includes a detent resiliently mounted on the housing, the detent recessing into the housing upon contact with the support and retracting back after the detent passes the support to releasably secure the housing on the support.

5. The monitor of claim 4, wherein one of the substantially spaced-apart legs is of sufficient length to substantially overlap the detent on an opposite spaced-apart leg.

6. The monitor of claim 4, wherein the detent has a cam surface to engage the support.

7. The monitor of claim 4, wherein the detent has a locking surface to secure the housing on the support.

8. The monitor of claim 4, wherein the detent is resiliently mounted on at least one of the spaced-apart legs.

9. The monitor of claim 4, wherein when the monitor is to be dismounted, the detent is depressed an amount such that the monitor is unsecured and removable from around the support.

10. The monitor of claim 3, wherein the securing mechanism includes resilient material mounted on at least one leg, the resilient material permitting a releasable securing of the monitor on the support.

11. The monitor of claim 1, wherein the acoustical means includes a microphone to detect the sounds.

12. The monitor of claims 1, wherein the electrical means includes at least one device to convert and transmit the sounds to a remotely located receiver.

13. The monitor of claim 1, further including at least one battery in the housing.

14. The monitor of claim 1, wherein the at least one battery is rechargeable.

15. The monitor of claim 13, wherein the housing includes charging contacts to re-energize the at least one rechargeable battery when the monitor is mated with a charger.

16. The monitor of claim 15, wherein the housing further includes openings for the charging contacts of the housing, the openings adapted to mate with bosses on the charger, each boss adapted to fit into a respectively configured opening of the housing for polarity reasons, thereby permitting a matching of the contacts of the charger with the respective contacts of the monitor.

17. The monitor of claim 1, further including a switch permitting a selection of monitor transmitting frequencies.

18. The monitor of claim 14, further including at least one indicator light showing a power status of the at least one rechargeable battery.

19. The monitor of claim 1, wherein at least one leg includes at least one indentation, the at least one indentation adapted to mate with at least one protrusion on a charger, such mating permitting the monitor to be aligned on the charger.

20. The monitor of claim 1, wherein at least one leg includes at least one protrusion, the at least one protrusion adapted to mate with at least one indentation on a charger, such mating permitting the monitor to be mounted on the charger.

21. The monitor of claim 1, wherein the electrical means is located in the base, the acoustical means is located in one of the spaced-apart legs, and at least one battery is located in the other spaced-apart leg and connected to the electrical means.

22. The monitor of claim 21, wherein the housing further includes openings for the charging contacts of the housing, the openings adapted to mate with bosses on the charger, each boss adapted to fit into a respectively configured opening of the housing for polarity reasons, thereby permitting a matching of the contacts of the charger with the respective contacts of the monitor.

23. A sound monitoring system, for sensing, transmitting and receiving sounds in a baby's vicinity, comprising:

a monitor, including a housing having a base and two substantially spaced-apart legs, the housing enclosing acoustical means and electrical means for, respectively, sensing and transmitting sounds, and the monitor being mountable on a support by straddling the support with the substantially spaced-apart legs;

a receiver, remotely located from the monitor, and configured to receive the sounds from the monitor and to announce the sounds out loud; and a charger having contacts, and configured to mountably receive and re-energize the monitor.

24. The system of claim 23, further including a securing mechanism.

25. The system of claim 24, wherein the securing mechanism includes a detent resiliently mounted on the housing, the detent recessing into the housing upon contact with the support and retracting back after the detent passes the support to releasably secure the housing on the support.

26. The system of claim 25, wherein the detent is resiliently mounted on at least one of the spaced-apart legs.

27. The system of claim 23, wherein at least one leg includes at least one indentation, the at least one indentation adapted to mate with at least one protrusion on a charger, such mating permitting the monitor to be mounted on the charger.

28. The system of claim 23, wherein at least one leg includes at least one protrusion, the at least one protrusion adapted to mate with at least one indentation on a charger, such mating permitting the monitor to be mounted on the charger.

29. The system of claim 28, wherein the at least one protrusion and the at least one indentation are on, respectively, only one side of the charger and the monitor for polarity reasons.

30. The system of claim 23, wherein the receiver includes an indication of whether the receiver is within a range to receive transmitted sounds from the monitor.

31. The system of claim 23, wherein the receiver includes a switch to select one of at least two frequencies of the transmitted sounds.

32. A method of securedly and releasably mounting a monitor to a support, the steps comprising:

providing a monitor that senses and transmits sounds in a baby's vicinity, the monitor including a housing having a base, two substantially spaced-apart legs and a securing mechanism, and the housing enclosing acoustical and electrical means for, respectively, sensing and transmitting the sounds, and the securing mechanism having a resiliently mounted detent;

straddling the support with the substantially spaced-apart legs;

engaging the resiliently mounted detent with the support, thereby recessing the resiliently mounted detent into the housing; and pushing the substantially spaced-apart legs around the support until the resiliently mounted detent retracts back after the detent passes the support, thereby releasably securing the monitor to the support.

33. A monitor for sensing and transmitting sounds in a baby's vicinity, comprising:

a housing having a base and two integral substantially spaced-apart legs, the housing enclosing acoustical means and electrical means for, respectively, sensing and transmitting the sounds;

the monitor being mountable on a support by straddling the support with the spaced-apart legs; and further including a securing mechanism.

34. A monitor for sensing and transmitting sounds in a baby's vicinity, comprising:

a housing having a base and two integral substantially spaced-apart legs, the housing enclosing acoustical means and electrical means for, respectively, sensing and transmitting the sounds;

the monitor being mountable on a support by straddling the support with the spaced-apart legs;

further including at least one battery in the housing; and wherein the housing includes charging contacts to re-energize the at least one rechargeable battery when the monitor is mated with a charger.

35. A monitor for sensing and transmitting sounds in a baby's vicinity, comprising:

a housing having a base and two integral substantially spaced-apart legs, the housing enclosing acoustical means and electrical means for, respectively, sensing and transmitting the sounds;

the monitor being mountable on a support by straddling the support with the spaced-apart legs; and wherein at least one leg includes at least one indentation, the at least one indentation adapted to mate with at least one protrusion on a charger, such mating permitting the monitor to be aligned on the charger.

36. A monitor for sensing and transmitting sounds in a baby's vicinity, comprising:

a housing having a base and two integral substantially spaced-apart legs, the housing enclosing acoustical means and electrical means for, respectively, sensing and transmitting the sounds;

the monitor being mountable on a support by straddling the support with the spaced-apart legs; and wherein at least one leg includes at least one protrusion, the at least one protrusion adapted to mate with at least one indentation on a charger, such mating permitting the monitor to be mounted on the charger.

37. A monitor for sensing and transmitting sounds in a baby's vicinity, comprising:

a housing having a base and two integral substantially spaced-apart legs, the housing enclosing acoustical means and electrical means for, respectively, sensing and transmitting the sounds;

the monitor being mountable on a support by straddling the support with the spaced-apart legs; and wherein the electrical means is located in the base, the acoustical means is located in one of the spaced-apart legs, and at least one battery is located in the other spaced-apart leg and connected to the electrical means.

* * * * *